US007947925B2

(12) United States Patent
Suzuki et al.

(10) Patent No.: US 7,947,925 B2
(45) Date of Patent: May 24, 2011

(54) HEATER UNIT AND BATTERY STRUCTURE WITH HEATER

(75) Inventors: Masahiko Suzuki, Hoi-gun (JP); Naoki Fukusako, Toyohashi (JP); Jun Okuda, Aichi-gun (JP); Yukie Uemura, Toyohashi (JP); Kunio Kanamaru, Okazaki (JP)

(73) Assignee: Panasonic EV Energy Co., Ltd., Kosai-shi (JP)

( * ) Notice: Subject to any disclaimer, the term of this patent is extended or adjusted under 35 U.S.C. 154(b) by 435 days.

(21) Appl. No.: 11/898,454

(22) Filed: Sep. 12, 2007

(65) Prior Publication Data

US 2008/0067162 A1 Mar. 20, 2008

(30) Foreign Application Priority Data

Sep. 19, 2006 (JP) ..... 2006-252827

(51) Int. Cl.
*H05B 1/00* (2006.01)

(52) U.S. Cl. ..... 219/209; 219/385; 219/536; 219/538

(58) Field of Classification Search ..... 219/204, 219/202, 212, 209, 385, 536, 538, 548, 549; 429/62, 176; 374/152
See application file for complete search history.

(56) References Cited

U.S. PATENT DOCUMENTS 2,418,792 A * 4/1947 Riggs ..... 429/62
2,516,048 A * 7/1950 Endress ..... 429/62
2,626,971 A * 1/1953 Mansoff ..... 429/120
3,110,633 A * 11/1963 Bachmann ..... 219/200
3,156,813 A * 11/1964 Trainor ..... 219/526
3,527,925 A * 9/1970 Nishida et al. ..... 219/521
4,081,737 A * 3/1978 Miyahara ..... 320/107
4,738,906 A * 4/1988 Sanders ..... 429/120
4,810,859 A * 3/1989 Anabtawi et al. ..... 219/535
5,039,927 A * 8/1991 Centafanti ..... 320/128
5,215,834 A * 6/1993 Reher et al. ..... 429/62
5,542,489 A * 8/1996 Allison et al. ..... 180/68.5
5,948,298 A * 9/1999 Ijaz ..... 219/209
6,189,487 B1 * 2/2001 Owen et al. ..... 119/28.5
2006/0091133 A1 * 5/2006 DiPucchio et al. ..... 219/545
2008/0093353 A1 * 4/2008 Suzuki et al. ..... 219/209
2008/0179315 A1 * 7/2008 Suzuki et al. ..... 219/549
2008/0198897 A1 * 8/2008 Suzuki et al. ..... 374/152

FOREIGN PATENT DOCUMENTS

DE 2643903 A * 3/1978
JP U 60-192367 12/1985

* cited by examiner

*Primary Examiner* — Geoffrey S. Evans
*Assistant Examiner* — Vinod D Patel
(74) *Attorney, Agent, or Firm* — Oliff & Berridge, PLC

(57) ABSTRACT

There are provided a heater unit and a battery structure with heater, which are capable of heating the battery structure appropriately and preventing a heater (part or whole of the heater) itself from excessively increasing in temperature. A first heater unit is provided with a first sheet heater, a first holding member holding it, and a first sheet placed between a lower surface of a first heater and the first holding member in such a manner as to be deformable in at least a direction of thickness of the first heater. The first heater is deformed when the first heater unit is fixed to the battery pack 50, thereby pressing the lower surface of the first heater to bring an upper surface of the first heater into close contact with an outer surface (a surface to be heated) of a spaced part of the battery pack.

8 Claims, 10 Drawing Sheets

HEATER UNIT AND BATTERY STRUCTURE WITH HEATER

BACKGROUND OF THE INVENTION

1. Field of the Invention

The present invention relates to a heater unit and a battery structure with heater including the heater unit.

2. Description of Related Art

Batteries such as nickel-metal hydride storage batteries have been watched as power sources of portable devices and power sources of electric vehicles, hybrid electric vehicles, and others.

However, the batteries such as nickel-metal hydride storage batteries have problems that discharge capacity is apt to decrease during cold conditions, failing to provide adequate output power. If such battery is used as a power source of an electric vehicle, a hybrid electric vehicle, or the like, for instance, it could not generate sufficient output power in low-temperature conditions, e.g., in a cold region where temperatures may fall to sub-zero.

In recent years, some techniques for solving the above problems by attaching a heater to a battery to heat the battery by use of a household power source have been proposed (e.g., Jpn. unexamined utility model publication No. 60(1985)-192367).

Jpn. unexamined utility model publication No. 60(1985)-192367 discloses a battery structure with heater, in which a sheet heater is placed on a bottom of a housing case made of a heat insulation material and two batteries are arranged in contact with the sheet heater in a container.

However, the technique disclosed in the above publication '367 may not heat the battery sufficiently. This disadvantage results from the following reasons. In some cases, deformation such as warp or distortion occurs in a bottom of a container made of a heat insulating material. If the sheet heater is also deformed, warped or distorted due to the deformation of the container, a gap is likely to be formed between the sheet heater and the battery. In this case, furthermore, the heat of the sheet heater is hard to conduct to the battery. This may cause an excessive increase in temperature of the sheet heater (part or whole of the heater) itself.

SUMMARY OF THE INVENTION

The present invention has been made in view of the above circumstances and has an object to provide a heater unit and a battery structure with heater, arranged to heat the battery structure appropriately, and prevent the temperature of the heater (part or whole of the heater) itself from excessively increasing.

To achieve the above object, the present invention provides a heater unit including: a sheet heater having a first surface and a second surface; and a holding member which holds the heater, the heater unit being arranged to be fixed to a battery structure that includes a power generating element to heat the power generating element by heating a surface of the battery structure to be heated, wherein the heater unit further comprises a sheet placed between the second surface of the heater and the holding member in such a manner as to be deformable in at least a direction of thickness of the heater, and the sheet can be deformed when the heater unit is fixed to the battery structure, pressing the second surface of the heater to bring the first surface of the heater in close contact with the surface of the battery structure to be heated.

The heater unit of the present invention is arranged to deform the sheet when the heater unit is fixed to the battery structure, pressing the second surface of the heater. Thus, the first surface of the heater can be brought into close contact with the surface of the battery structure to be heated (hereinafter, referred to as a "heated surface"). Accordingly, no gap is formed between the first surface of the heater and the heated surface of the battery structure and therefore the battery structure can be heated appropriately. Furthermore, the heat of the heater can be conducted to the battery structure properly, which makes it possible to prevent the temperature of the heater (part or whole of the heater) itself from excessively rising.

The sheet may include e.g. a sheet elastically deformable in a direction of thickness. Concrete examples thereof are a resin foam (urethane foam or the like) sheet, a foam rubber sheet, a porous fiber sheet, a molded glass wool sheet, etc. Further, a gelatinous element or a sheet having a base material sheet on which a gelatinous element is adhered may be used. Here, the gelatinous element may include a gelatinous high polymer compound such as polyhydroxy ethyl methacrylate, polyvinyl pyrrolidone, and a copolymer of buthyl acrylate and buthyl methacrylate. Alternatively, a pouched sheet containing fluid such as liquid may also be used.

The surface of the sheet is not limited to a flat surface and may be an uneven surface with a number of projections formed all over the surface at regular intervals.

The battery structure may include: a cell constituted of a single power generating element accommodated in a battery case; a battery module including a plurality of power generating elements accommodated in a battery case having a plurality of compartments individually housing the power generating elements; and a battery pack including cells or battery modules arranged in series or in parallel to each other, which are held with a housing, a holding frame, or the like.

The "power generating element" is accommodated in a battery case for providing a battery function and for example includes positive plates, negative plates, separators, and electrolyte.

The sheet heater may be for example a laminated sheet heater including a heater element extending in a predetermined pattern along a plane (e.g., made of nickel-chromium alloy) and insulating resin layers (e.g. polyimide films) laminated on both surfaces of a heater element. Further, a sheet heater provided with metal layers (e.g., aluminum plates) on both sides may be used.

The heated surface is for example an outer surface (part or whole of the outer surface) of the battery structure of the battery pack or the like. In this case, the entire first surface of the sheet heater is preferably brought into close contact with the outer surface of the battery structure. As a concrete example, the outer surface of the battery structure includes a flat surface on which the heater is placed (or which is covered by the heater), so that a flat heater is fixed to the flat surface. In this case, when the sheet is deformed to press the second surface of the heater, the entire first surface of the heater is allowed to make close contact with the flat surface entirely. This entire flat surface can therefore serve as the heated surface.

The present invention includes a heater unit arranged so that part of the first surface of the heater makes close contact with the outer surface of the battery structure such as a battery pack. As a concrete example, the outer surface of the battery structure includes a partly-recessed surface (e.g., a surface having one or more recesses formed by press molding for reinforcement) on which the heater is placed (or which is covered by the heater), so that a flat heater is fixed to the partly-recessed surface. A portion of the partly-recessed surface other than the recess is flat. In this case, when the sheet is deformed to press the second surface of the heater, the part of the first surface of the heater is brought into close contact with the flat portion of the partly-recessed surface. The flat portion of the partly-recessed excepting the recess can therefore serve as the heated surface.

Even in the case where part of the first surface of the heater is brought into close contact with the heated surface as mentioned above, a gap is unlikely to be formed between the heated surface and the portion of the first surface of the heater brought into contact with the heated surface by pressure of the sheet. As compared with a heater unit having no sheet, accordingly, heating efficiency of the battery structure can be increased. Further, the portion of the first surface of the heater which is brought into close contact with the heated surface can conduct the heat of the heater to the battery structure appropriately. It is therefore superior to the heater unit having no sheet in preventing the heater itself from excessively increasing in temperature of the portion held in close contact with the heated surface.

The heated surface is not limited to a flat surface (a flat portion) and may be a curved surface or a partly-uneven surface with recesses and protrusions. On the other hand, the sheet heater and the sheet are preferably formed in a shape conformable to the shape of the heated surface with which the heater and the sheet are to be brought into contact. When the heated surface corresponds to an outer periphery of a quarter cylindrical shape, for example, the sheet heater and the sheet should also be formed in a quarter cylindrical shape conforming the heated surface.

In the aforementioned heater unit, preferably, the sheet is elastically deformable in the direction of thickness of the heater, and the sheet can be elastically compressed and deformed in the direction of thickness of the heater when the heater unit is fixed to the battery structure, bringing the first surface of the heater in close contact with the surface of the battery structure to be heated by an elastic force caused by elastically compressive deformation of the sheet.

Alternatively, there is preferably provided a heater unit including a sheet heater having a first surface and a second surface and a holding member which holds the heater, the heater unit being arranged to be fixed to a battery structure including a power generating element and to heat the power generating element by heating the heated surface of the battery structure, wherein the heater unit further comprises a sheet placed between the second surface of the heater and the holding member in such a manner as to be elastically deformable in a direction of thickness of the heater, wherein the heater unit is configured to satisfy a relation of $L>M$, where L is the total thickness of the heater and the sheet in an original state prior to fixation to the battery structure and M is the total thickness of the heater and the sheet in the heater unit fixed to the battery structure so that the first surface of the heater makes contact with the heated surface.

This heater unit is provided with the sheet placed between the second surface of the heater and the holding member in such a manner as to be deformable in the direction of thickness of the heater. And the heater unit is configured to satisfy the relation of $L>M$, where the L is the total thickness of the heater and the sheet in the original state and M is the total thickness of the heater and the sheet in a fixed state to the battery structure. When the heater unit is fixed to the battery structure, specifically, the sheet is elastically deformed in a compressive state in the direction of thickness of the heater, reducing the total thickness of the heater and the sheet from L to M.

According to the heater unit, therefore, the first surface of the heater is allowed to make contact with the heated surface of the battery structure by the elastic force deriving from the elastically compressive deformation of the sheet. Thus, no gap is formed between the first surface of the heater and the heated surface of the battery structure, so that the battery structure can be heated appropriately. Furthermore, the heat of the heater can be conducted to the battery structure appropriately, thereby preventing the temperature of the heater (part or whole of the heater) itself from excessively increasing.

In the aforementioned heater unit, preferably, the holding member is arranged to detachably attach the heater unit to the battery structure.

In the aforementioned heater unit, preferably, the sheet is placed on the entire second surface of the heater.

In the aforementioned heater unit, preferably, the heater is bonded to the sheet, and the sheet is bonded to the holding member.

In the aforementioned heater unit, preferably, the sheet has heat insulating properties.

According to another aspect, the present invention provides a battery structure with heater, comprising; the aforementioned heater unit; and the battery structure including the power generating element and having the surface to be heated; wherein the sheet of the heater unit is deformed to press the second surface of the heater to bring the first surface of the heater into close contact with the surface of the battery structure to be heated.

According to another aspect, furthermore, the present invention provides a battery structure with heater, comprising: a battery structure including a power generating element and having a surface to be heated; and a heater unit including: a sheet heater having a first surface and a second surface, and a holding member which holds the heater, the heater unit being fixed to the battery structure to heat the surface of the battery structure to be heated to heat the power generating element, wherein the heater unit further includes a sheet placed between the second surface of the heater and the holding member in such a manner as to be deformable in at least a direction of thickness of the heater, and the sheet is deformed to press the second surface of the heater to hold the first surface of the heater in close contact with the surface of the battery structure to be heated.

In the battery structure with heater of the present invention, the heater unit includes the sheet placed between the second surface of the heater and the holding member in such a manner as to be deformable in at least the direction of thickness of the heater. When the sheet is deformed to press the second surface of the heater, accordingly, the first surface of the heater makes close contact with the heated surface of the battery structure. No gap is therefore formed between the first surface of the heater and the heated surface, thereby enabling appropriate heating of the battery structure. Furthermore, the heat of the heater can be conducted to the heated surface appropriately, thus preventing the temperature of the heater (part or whole of the heater) itself from excessively increasing.

An example of the heated surface is an outer surface (part or whole of the outer surface) of the battery structure. In this case, the entire first surface of the sheet heater is preferably in close contact with the outer surface of the battery structure. To be specific, as an example, a battery structure with heater configured such that part of the outer surface of the battery structure on which the heater is placed is entirely flat, and a flat heater is fixed to such flat surface. In this battery structure with heater, the sheet is deformed to press the second surface of the heater, thereby holding the entire first surface of the heater in close contact with the flat surface. Thus, the flat surface can serve as the heated surface.

The present invention includes a battery structure with heater, in which part of the first surface of the heater is in close contact with the outer surface of the battery structure such as the battery pack. Specifically, as an example, the battery structure with heater is configured such that the outer surface of the battery structure includes a partly-recessed surface (e.g., having a recess formed by press molding for reinforcement) on which the heater is placed, so that a flat heater is fixed to the recessed surface. A portions of the partly-recessed surface other than the recess is flat. In this battery structure with heater, when the sheet is deformed to press the second surface of the heater, the part of the first surface of the heater can be held in close contact with the flat portion of the partly-recessed surface. The flat portion excepting the recess can therefore serve as the heated surface.

Even in the battery structure with heater, in which part of the first surface of the heater is in close contact with the heated surface as mentioned above, a gap is unlikely to be formed between the heated surface and the portion of the first surface of the heater which is held in contact with the heated surface by pressure of the sheet. As compared with a battery structure with heater including a heater unit having no sheet, accordingly, heating efficiency of the battery structure can be increased. Further, the portion of the first surface of the heater which is in close contact with the heated surface can conduct the heat of the heater to the battery structure appropriately. It is therefore superior to the battery structure with heater provided with the heater unit having no sheet in preventing the heater itself from excessively increasing in temperature of the portion closely making contact with the heated surface.

In the aforementioned battery structure with heater, preferably, the sheet is elastically deformable in the direction of thickness of the heater, the first surface of the heater is held in close contact with the surface of the battery structure to be heated by an elastic force caused by elastically compressive deformation of the sheet.

The battery structure with heater is preferably arranged such that, in the aforementioned battery structure with heater, the holding member is configured to detachably attach the heater unit to the battery structure.

The battery structure with heater is preferably arranged such that, in the aforementioned battery structure with heater, the sheet is in contact with the entire second surface of the heater.

The battery structure with heater is preferably arranged such that, in the aforementioned battery structure with heater, preferably, the heater is bonded to the sheet, and the sheet is bonded to the holding member.

The battery structure with heater is preferably arranged such that, in the aforementioned battery structure with heater, preferably, the sheet has heat insulating properties.

DETAILED DESCRIPTION OF THE PREFERRED EMBODIMENTS

A detailed description of a preferred embodiment of a battery structure with heater (hereinafter, referred to as a "heater-equipped battery structure") 10 according to the present invention will now be given referring to the accompanying drawings.

Figure 1:
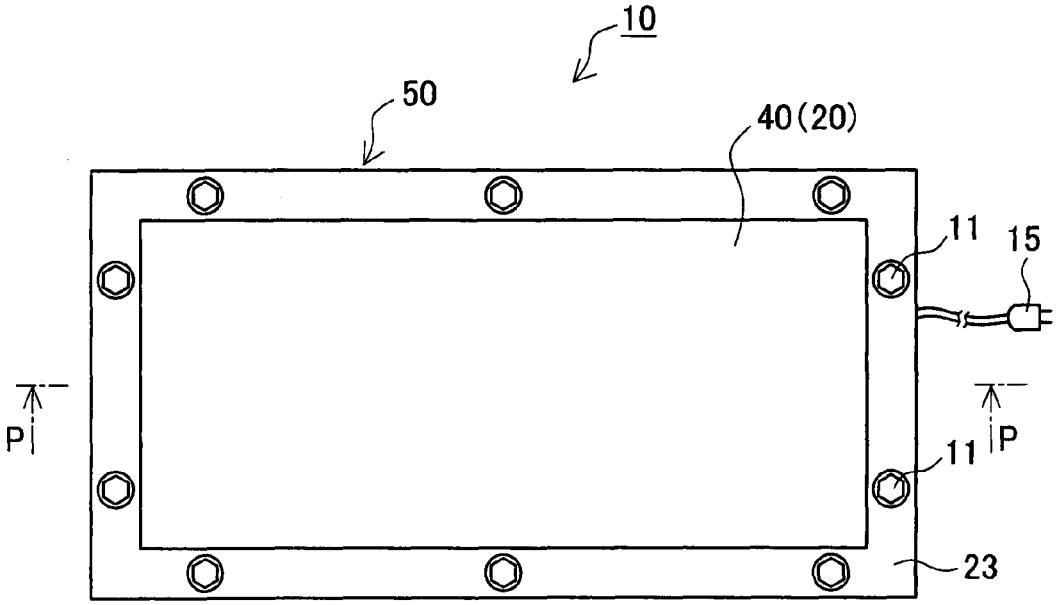
FIG. 1 is a top view of a battery structure with heater of a preferred embodiment.
Figure 2:
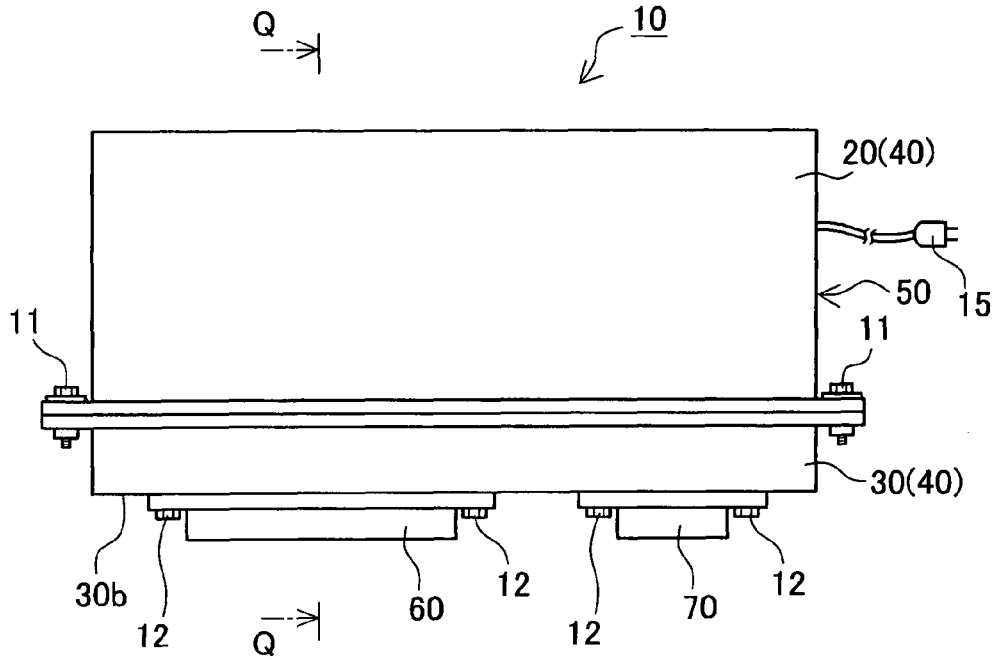
FIG. 2 is a side view of the battery structure with heater of the embodiment.

The heater-equipped battery structure 10 includes a battery pack 50, a first heater unit 60, and a second heater unit 70 as shown in FIGS. 1 and 2.

Figure 3:
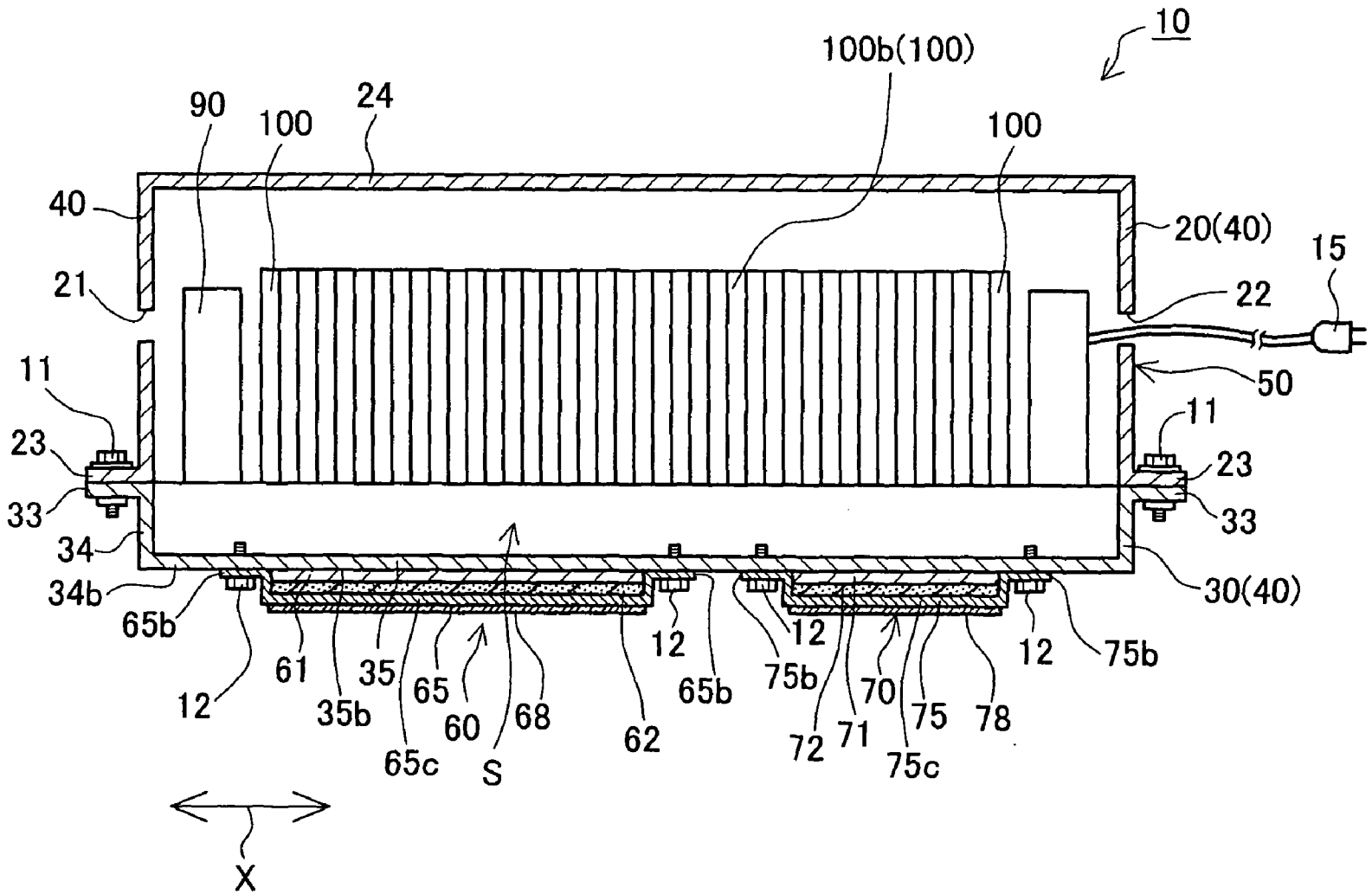
FIG. 3 is a sectional view of the battery structure with heater, taken along a line P-P in FIG. 1.

The battery pack 50 includes a housing case 40 constituted of a first housing member 20 and a second housing member 30, and a plurality of secondary batteries 100 (forty batteries in the present embodiment) housed in the housing case 40, as shown in FIG. 3. In the present embodiment, the battery pack 50 corresponds to a battery structure.

Figure 4:
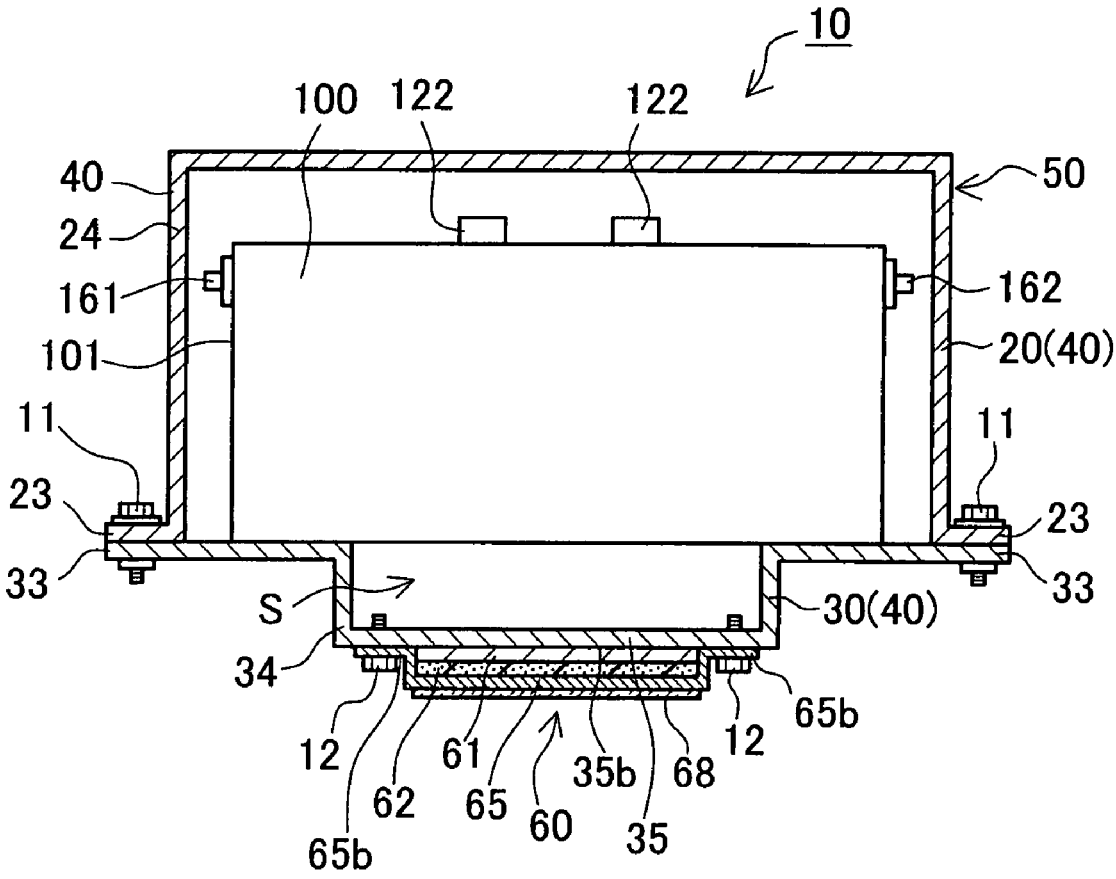
FIG. 4 is a sectional view of the battery structure with heater, taken along a line Q-Q in FIG. 2.
Figure 5:
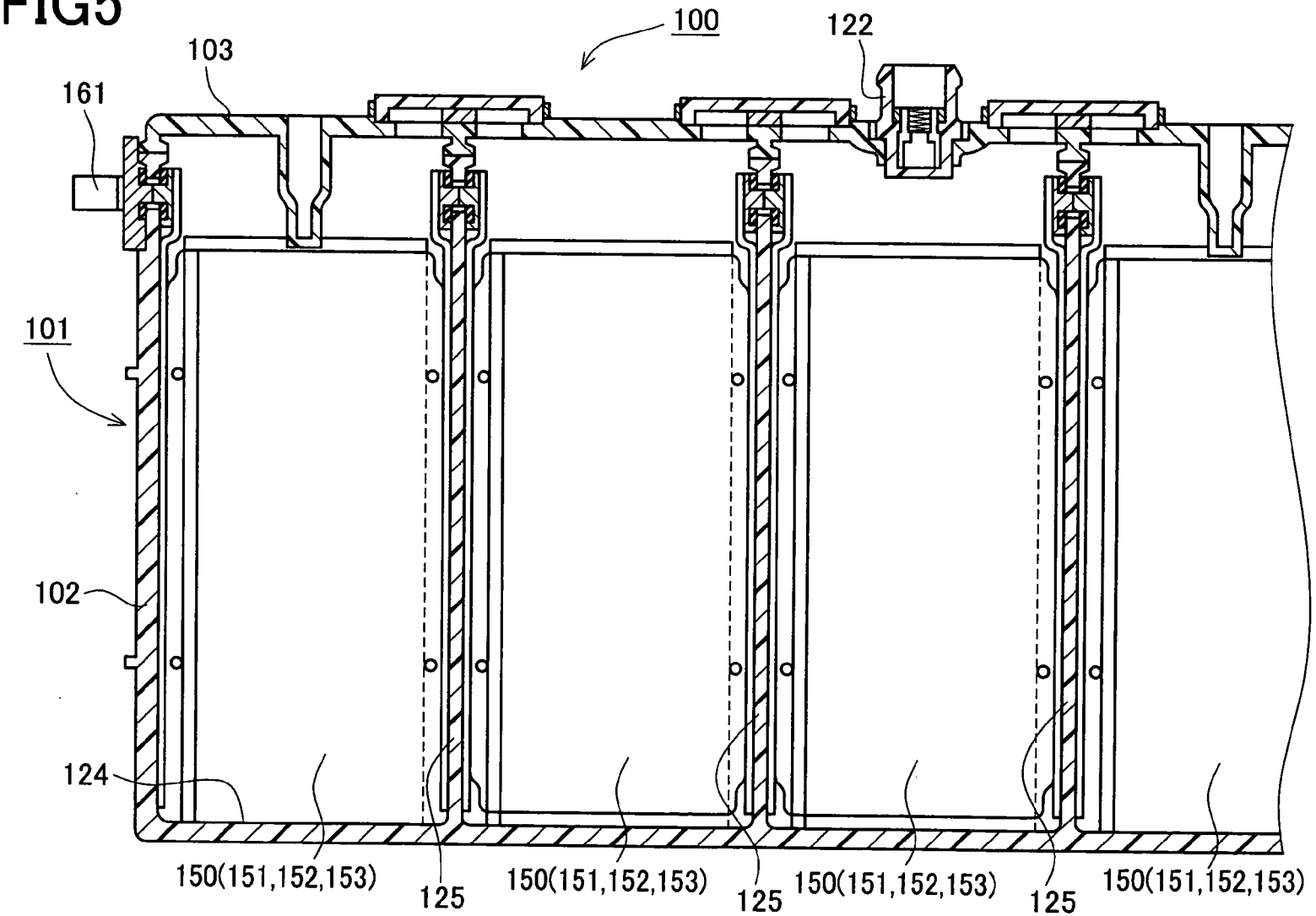
FIG. 5 is a sectional view of a secondary battery of the present embodiment.

Each secondary battery 100 is a nickel-metal hydride storage sealed battery provided with a battery case 101, a positive terminal 161 and a negative terminal 162, as shown in FIG. 4. The battery case 101 has a resin case body 102 of a nearly rectangular box shape and a resin cover 103 of a nearly rectangular plate shape. The case body 102 is internally divided into six compartments 124 by partition walls 125. Each compartment 124 accommodates an electrode plate group 150 (positive plates 151, negative plates 152, and separators 153) and an electrolyte (not shown). The electrode plate groups 150 individually accommodated in the compartments 124 are connected in series to one another. Thus, the secondary battery 100 of the present embodiment constitutes a battery module including six cells connected in series. The electrode plate group 150 and the electrolyte (not shown) correspond to a power generating element. The cover 103 is provided with a safety valve 122.

In the present embodiment, as shown in FIG. 3, forty secondary batteries 100 configured as above are arranged in a row in a row direction X (a lateral direction in FIG. 3) and connected in series to one another.

The first housing member 20 is made of metal in a rectangular recessed form which includes a housing part 24 housing the secondary batteries 100 and a rectangular annular flange 23 surrounding an open end of the housing part 24. The second housing member 30 includes a rectangular recessed metal part 34 and a rectangular annular flange 33 surrounding an open end of the recessed part 34.

On the flange 33 of the second housing member 30, the secondary batteries 100 are fixedly placed (see FIGS. 3 and 4). Further, the first housing member 20 is fixed to the second housing member 30 with mounting bolts 11 so that the flange 23 is placed in contact with the flange 33 of the second housing member 30, containing the secondary batteries 100 in the housing part 24.

The thus configured battery pack 50 includes, as part of a bottom wall **34*b* of the recessed part 34 of the second housing member 30, a part 35 located in spaced relation to the secondary batteries 100, leaving a space S therefrom, as shown in FIGS. 3 and 4. This part 35** is hereinafter referred to as a "spaced part".

The first heater unit 60 includes a first heater 61, a first sheet 62, a first holder 65 that holds them, and a heat insulating member 68. The first heater 61 is bonded to an upper surface 62*b* of the first sheet 62 which is bonded to a holding surface 65*f* of the first holder 65. The heat insulating member 68 is bonded to a surface 65*g* (a lower surface in FIG. 6) of the holder 65 opposite the holding surface 65*f*. Thus, the first heater unit 60 is constituted of the first heater 61, the first sheet 62, the first holder 65, and the heat insulating member 68 which are integrally bonded to one another.

Figure 8:
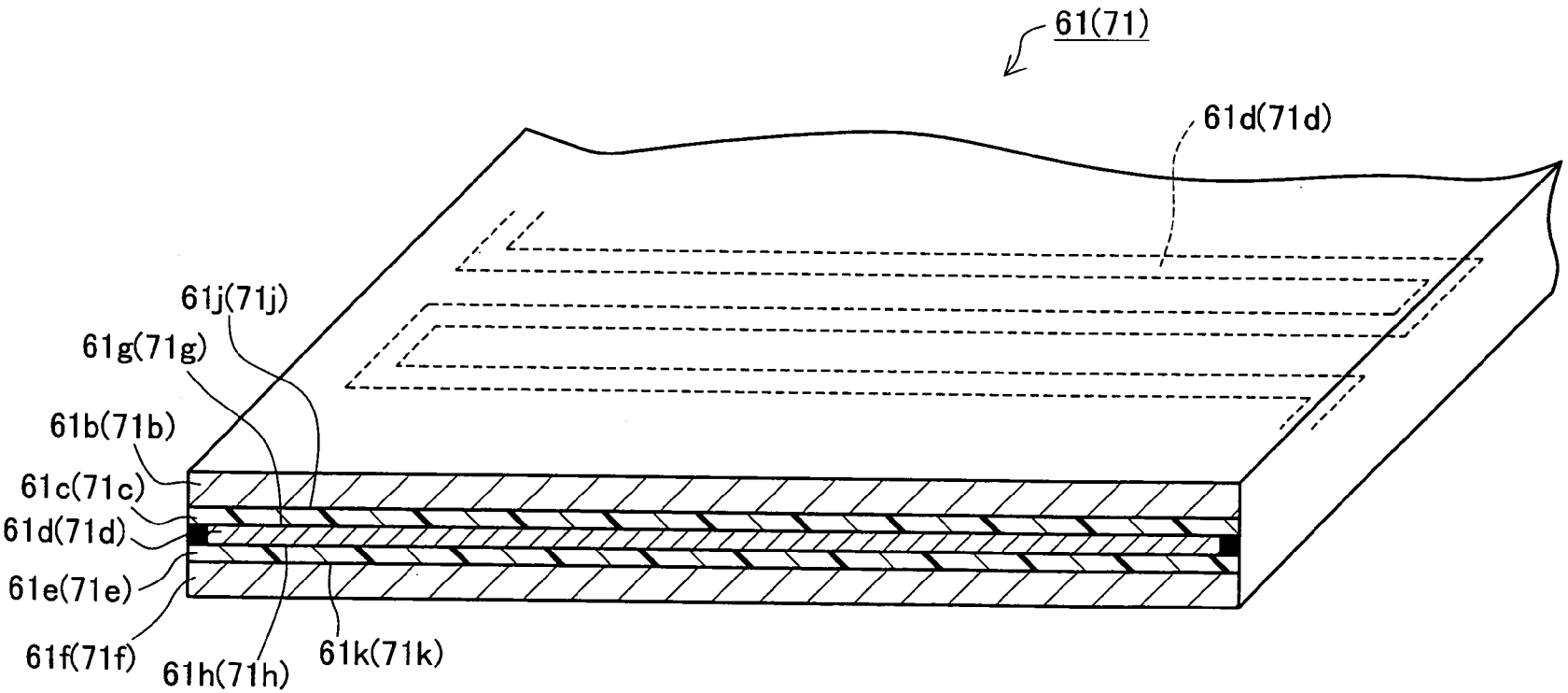
FIG. 8 is a perspective sectional view of a first heater (a second heater)

The first heater 61 is a sheet heater of a laminated structure, as shown in FIG. 8, including a heater element 61*d* extending along a plane in a predetermined pattern indicated by a dotted line, a first insulating resin layer 61*c* laminated on an upper surface 61*g* of the heater element 61*d* and a second insulating resin layer 61*e* laminated on a lower surface 61*h* of the heater element 61*d*, and a first metal layer 61*b* laminated on an upper surface 61*j* of the first insulating resin layer 61*c* and a second metal layer 61*f* laminated on a lower surface 61*k* of the second insulating resin layer 61*e*. The heater element 61*d* is made of nickel-chromium alloy. The first and second insulating resin layers 61*c* and 61*e* are formed of polyimide films. The first and second metal layers 61*b* and 61*f* are formed of aluminum plates.

The first sheet 62 is an urethane foam sheet, which is placed between a lower surface 61*n* (a second surface) and the first holder 65. This first sheet 62 is elastically deformable in a direction of thickness of the first heater 61 (in a vertical direction in FIG. 6).

The first holder 65 is formed in recessed rectangular shape, including a holding part 65*c* internally holding the first heater 61 and a rectangular annular flange 65*b* surrounding an open end of the holding part 65*c*. This flange 65*b* is formed with a plurality of through holes 65*d* each allowing a threaded portion 12*b* of a mounting bolt 12 to pass through as shown in FIG. 9.

Figure 9:
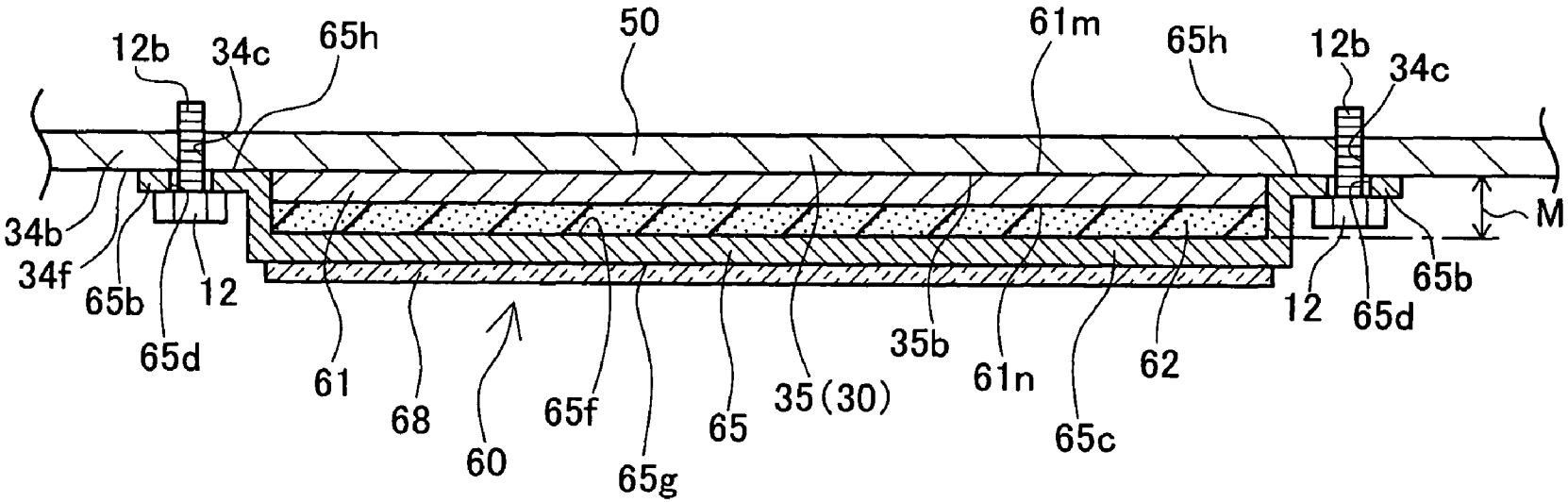
FIG. 9 is a partially enlarged sectional view of the battery structure with heater, including the first heater unit 60 and its surrounding.

The bottom wall 34*b* of the second housing member 30 is formed with threaded holes 34*c* in positions corresponding to the through holes 65*d* of the first heater unit 60 as shown in FIG. 9. Each of the threaded holes 34*c* is configured to threadably engage with the threaded portion 12*b* of the mounting bolt 12. In the present embodiment, the threaded portion 12*b* of the mounting bolt 12 is inserted through the through hole 65*d* of the flange 65*b* and tightened in the threaded hole 34*c* of the bottom wall 34*b* of the second housing member 30, thereby detachably fixing the first heater unit 60 to an outer surface 34*f* of the bottom wall 34*b* of the second housing member 30.

As above, the first heater unit 60 is detachably provided outside the housing case 40 (i.e., on the outer surface 34*f* of the bottom 34*b* of the second housing member 30). Accordingly, the first heater unit 60 can easily be detached from and attached to the housing case 40 of the battery pack 50. This configuration can improve workability in maintenance, replacement, or the like for the first heater 61. In particular, the first heater unit 60 of the present embodiment is constituted of the first heater 61, the first sheet 62, the first holder 65, and the heat insulating member 68 which are integrally bonded to one another, so that the first heater unit 60 can be handled easily, facilitating a mounting work with respect to the battery pack 50 or other works.

Figure 6:
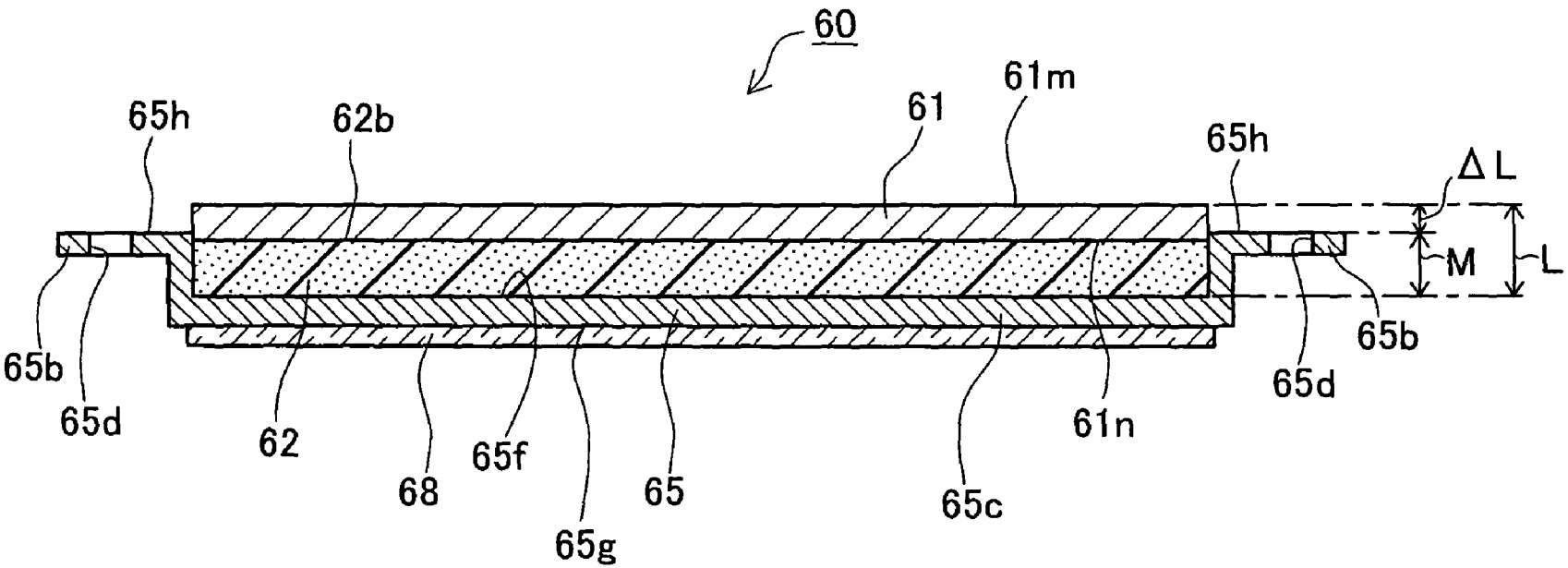
FIG. 6 is a sectional view of a first heater unit.

Meanwhile, in the first heater unit 60 of the present embodiment, in an original state prior to fixation to the battery pack 50, the total thickness of the first heater 61 and the first sheet 62 is assumed to be L and the first heater 61 protrudes by a distance ΔL from a contact surface 65*h* of the flange 65*b* of the first holder 65 as shown in FIG. 6. The contact surface 65*h* of the flange 65*b* is a surface that makes contact with the outer surface 34*f* of the bottom 34*b* of the second housing member 30 when the first heater unit 60 is fixed to the battery pack 50 as shown in FIG. 9.

When this first heater unit 60 is fixedly placed on the outer surface 34*f* of the bottom 34*b* of the second housing member 30 as mentioned above, as shown in FIG. 9, the total thickness of the first heater 61 and the first sheet 62 is reduced from L to M (see FIG. 6). At that time, the first sheet 62 is elastically compressed and deformed by the distance ΔL (ΔL=L−M) (see FIG. 6) in the direction of thickness of the first heater 61 (in the vertical direction in FIG. 9). By an elastic force caused by this elastically compressive deformation, an upper surface 61*m* (a first surface) of the first heater 61 can be held in close contact with the outer surface 35*b* of the spaced part 35.

Particularly, in the first heater unit 60, the entire first sheet 62 is in contact with the lower surface 61*n* of the first heater 61. Thus, the entire lower surface 61*n* of the first heater 61 can be pressed by the elastic force of the first sheet 62, thereby adequately bringing the upper surface 61*m* of the first heater 61 into close contact with the outer surface 35*b* of the spaced part 35. As a result, no gap is formed between the upper surface 61*m* of the first heater 61 and the outer surface 35*b* of the spaced part 35, and therefore the battery pack 50 can be heated properly. Furthermore, the heat of the first heater 61 can appropriately be conducted to the battery pack 50, thereby preventing the temperature of the first heater 61 (part or whole of the first heater 61) itself from excessively increasing.

In the present embodiment, the outer surface 35*b* of the spaced part 35 corresponds to a surface to be heated (a heated surface).

Figure 7:
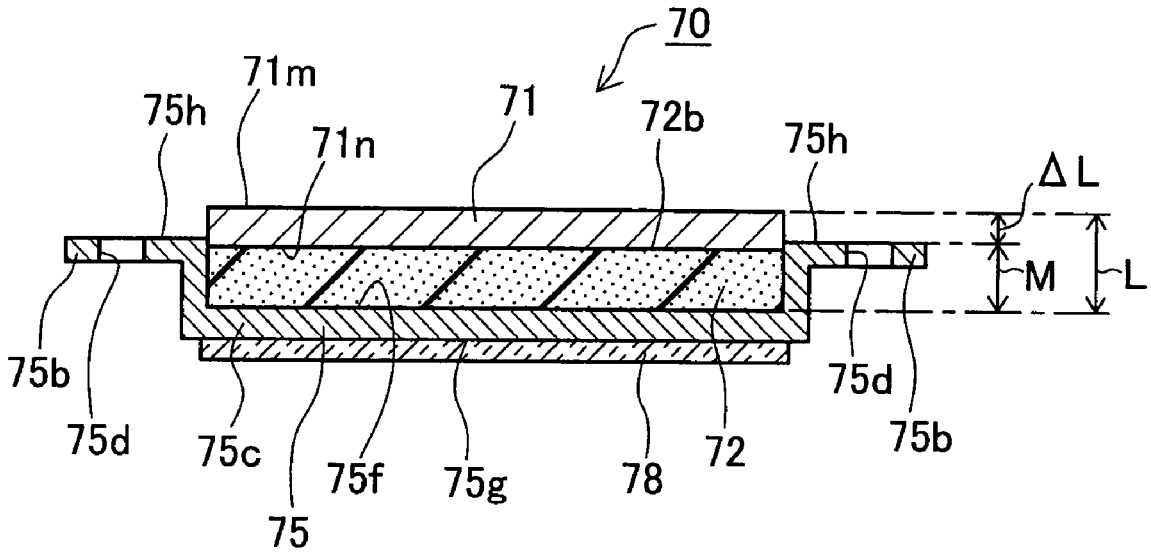
FIG. 7 is a sectional view of a second heater unit.

The second heater unit 70 includes a second heater 71, a second sheet 72, a second holder 75 that holds them, and a heat insulting material 78, as shown in FIG. 7. The second heater 71 is bonded to an upper surface 72*b* of the second sheet 72 which is bonded to a holding surface 75*f* of the second holder 75. The heat insulating member 78 is bonded to a surface 75*g* (a lower surface in FIG. 7) of the holder 75 opposite the holding surface 75*f*. Thus, the second heater unit 70 is constituted of the second heater 71, the second sheet 72, the second holder 75, and the heat insulating member 78 which are integrally bonded to one another.

The second heater 71 is a sheet heater of a laminated structure, as shown by reference codes in parentheses in FIG. 8, including a heater element 71*d* extending along a plane in a predetermined pattern indicated by a dotted line, a first insulating resin layer 71*c* laminated on an upper surface 71*g* of the heater element 71*d* and a second insulating resin layer 71*e* laminated on a lower surface 71*h* of the heater element 71*d*, and a first metal layer 71*b* laminated on an upper surface 71*j* of the first insulating resin layer 71*c* and a second metal layer 71*f* laminated on a lower surface 71*k* of the second insulating resin layer 71*c*. The heater element 71*d* is made of nickel-chromium alloy. The first and second insulating resin layers 71*c* and 71*e* are formed of polyimide films. The first and second metal layers 71*b* and 71*f* are formed of aluminum plates.

The second sheet 72 is an urethane foam sheet placed between a lower surface 71*n* (a second surface) of the second heater 71 and the second holder 75. This second sheet 72 is elastically deformable in a direction of thickness of the second heater 71 (in a vertical direction in FIG. 7).

The second holder 75 is formed in rectangular recessed shape, including a holding part 75*c* internally holding the second heater 71 and a rectangular annular flange 75*b* surrounding an open end of the holding part 75*c*. This flange 75*b* is formed with a plurality of through holes 75*d* each allowing a threaded portion 12*b* of a mounting bolt 12 to pass through as shown in FIG. 10.

Figure 10:
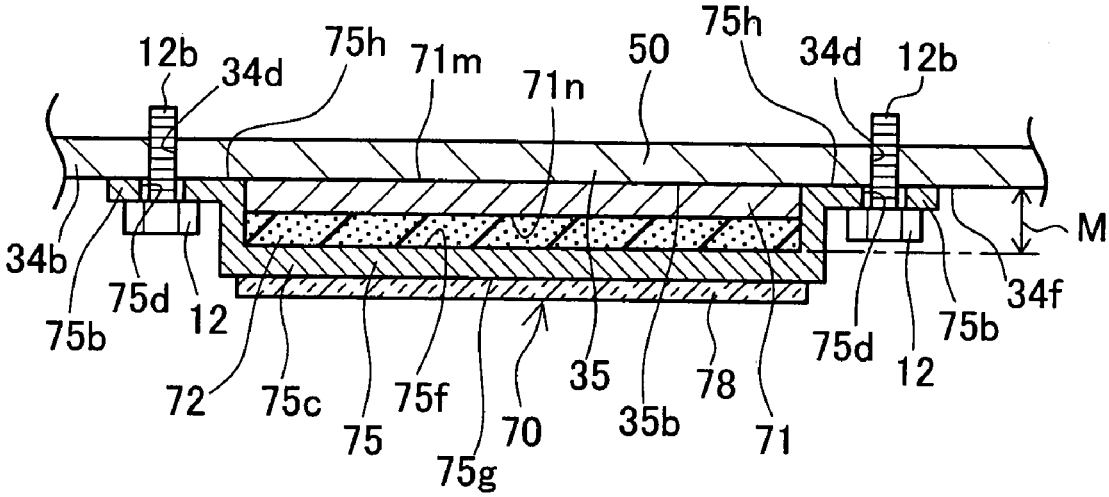
FIG. 10 is a partially enlarged sectional view of the battery structure with heater, including the second heater unit 70 and its surrounding.

The bottom wall 34*b* of the second housing member 30 is formed with threaded holes 34*c* in positions corresponding to the through holes 75*d* of the second heater unit 70 as shown in FIG. 10. Each of the threaded holes 34*c* is configured to threadably engage with the threaded portion 12*b* of the mounting bolt 12. In the present embodiment, the threaded portion 12*b* of the mounting bolt 12 is inserted through the through hole 75*d* of the flange 75*b* and tightened in the threaded hole 34*d* of the bottom wall 34*b* of the second housing member 30, thereby detachably fixing the second heater unit 70 to the outer surface 34*f* of the bottom wall 34*b* of the second housing member 30.

As above, the second heater unit 70 is detachably provided outside the housing case 40 (i.e., on the outer surface 34*f* of the bottom 34*b* of the second housing member 30). Accordingly, the second heater unit 70 can easily be detached from and attached to the housing case 40 of the battery pack 50. This configuration can improve workability in maintenance, replacement, or the like for the second heater 71. In particular, the second heater unit 70 of the present embodiment is constituted of the second heater 71, the second sheet 72, the second holder 75, and the heat insulating member 78 which are integrally bonded to one another, so that the second heater unit 70 can be handled easily, facilitating a mounting work with respect to the battery pack 50 or other works.

Furthermore, in the second heater unit 70 as with the first heater unit 60, in an original state prior to fixation to the battery pack 50, the total thickness of the second heater 71 and the second sheet 72 is L and the second heater 71 protrudes by a distance ΔL from a contact surface 75*h* of the flange 75*b* of the second holder 75 as shown in FIG. 7. The contact surface 75*h* of the flange 75*b* is a surface making contact with the outer surface 34*f* of the bottom 34*b* of the second housing member 30 when the second heater unit 70 is fixed to the battery pack 50 as shown in FIG. 10.

With this second heater unit 70 is fixed to the outer surface 34*f* of the bottom 34*b* of the second housing member 30 as mentioned above, as shown in FIG. 10, the total thickness of the second heater 71 and the second sheet 72 is reduced from L to M (see FIG. 7). At that time, the second sheet 72 is elastically compressed and deformed by the distance ΔL (ΔL=L−M) (see FIG. 7) in the direction of thickness of the second heater 71 (in the vertical direction in FIG. 10). By an elastic force caused by this elastically compressive deformation, an upper surface 71*m* (a first surface) of the second heater 71 can be held in close contact with the outer surface 35*b* of the spaced part 35.

Particularly, in the second heater unit 70, the entire second sheet 72 is in contact with the lower surface 71*n* of the second heater 71. Thus, the entire lower surface 71*n* of the second heater 71 can be pressed by the elastic force of the second sheet 72, thereby adequately brining the upper surface 71*m* of the second heater 71 into close contact with the outer surface 35*b* of the spaced part 35. As a result, no gap is formed between the upper surface 71*m* of the second heater 71 and the outer surface 35*b* of the spaced part 35, and therefore the battery pack 50 can be heated properly. Furthermore, the heat of the second heater 71 can appropriately be conducted to the battery pack 50, thereby preventing the temperature of the second heater 71 (part or whole of the second heater 71) itself from excessively increasing.

The first heater 61 and the second heater 71 are heaters that can be energized or powered by a household AC power source to generate heat. The first heater 61 and the second heater 71 are electrically connected to an alternator plug 15 as shown in FIG. 3. Accordingly, the alternator plug 15 is connected to an outlet of the household AC power source to supply electric power to the first heater. 61 and the second heater 71, thereby causing them to generate heat.

Next, a heating function of the heater-equipped battery structure 10 will be described in detail.

In the heater-equipped battery structure 10 of the present embodiment, as mentioned above, the first heater 61 and the second heater 71 are placed on the outer surface 35*b* of the spaced part 35 of the second housing member 30 (the housing case 40) (see FIG. 3). This configuration allows the heat of the first heater 61 and the second heater 71 to be conducted to the spaced part 35, thus heating the air in the space S through the heated spaced part 35. Then, each secondary battery 100 is exposed to the heated air and heated.

According to the above heating manner, it is possible to prevent uneven heating among the secondary batteries 100 of the battery pack 50 and thus reduce variations in temperature among the secondary batteries 100. This makes it possible to reduce variations in output characteristics among the secondary batteries 100. The entire battery pack 50 can therefore produce stable output.

As well as the spaced part 35, the space S exists between each of the heaters 61 and 71 and each of the secondary batteries 100. Accordingly, even where the temperatures of the first heater 61 and the second heater 71 abnormally rise due to any failure or malfunction, each secondary battery 100 can be prevented from excessively increasing in temperature.

Furthermore, as mentioned above, the upper surface 61*m* of the first heater 61 is held in close contact with the outer surface 35*b* of the spaced part 35 by the elastic force of the first sheet 62. Simultaneously, the upper surface 71*m* of the second heater 71 is held in close contact with the outer surface 35*b* of the spaced part 35 by the elastic force of the second sheet 72. The battery pack 50 can therefore be heated appropriately. Furthermore, the heat of the first heater 61 and the second heater 71 can be conducted adequately to the battery pack 50, which can prevent the first heater 61 and the second heater 71 from excessively increasing in temperature.

In the first heater unit 60 of the present embodiment, the first sheet 62 made of urethane foam is used for a sheet placed on the lower surface 61*n* of the first heater 61. Similarly, the second sheet 72 formed of urethane foam is used for a sheet placed on the lower surface 71*n* of the second heater 71. Those first and second sheets 62 and 72 formed of urethane foam have heat insulating properties. Accordingly, the heat of the first and second heaters 61 and 71 are unlikely to escape from the lower surfaces 61*n* and 71*n*. This configuration therefore allows the heat of the first and second heaters 61 and 71 to be efficiently conducted to the spaced part 35 of the housing case 40.

As shown in FIG. 6, the first heater unit 60 of the present embodiment is provided with the heat insulating member 68 under the lower surface 65*g* of the holder 65 opposite the holding surface 65*f*. Similarly, as shown in FIG. 7, the second heater unit 70 is also provided with the insulating member 78 under the lower surface 75*g* of the holder 75 opposite the holding surface 75*f* holding the second heater 71. Accordingly, the heat of the first and second heaters 61 and 71 are unlikely to escape from the lower surfaces 65*g* and 75*g* of the holding members 65 and 75.

In the heater-equipped battery structure 10 of the present embodiment having the above configuration, the heat of the first and second heaters 61 and 71 can efficiently be conducted to the spaced part 35 of the housing case 40. Thus, each secondary battery 100 can be heated efficiently.

Figure 11:
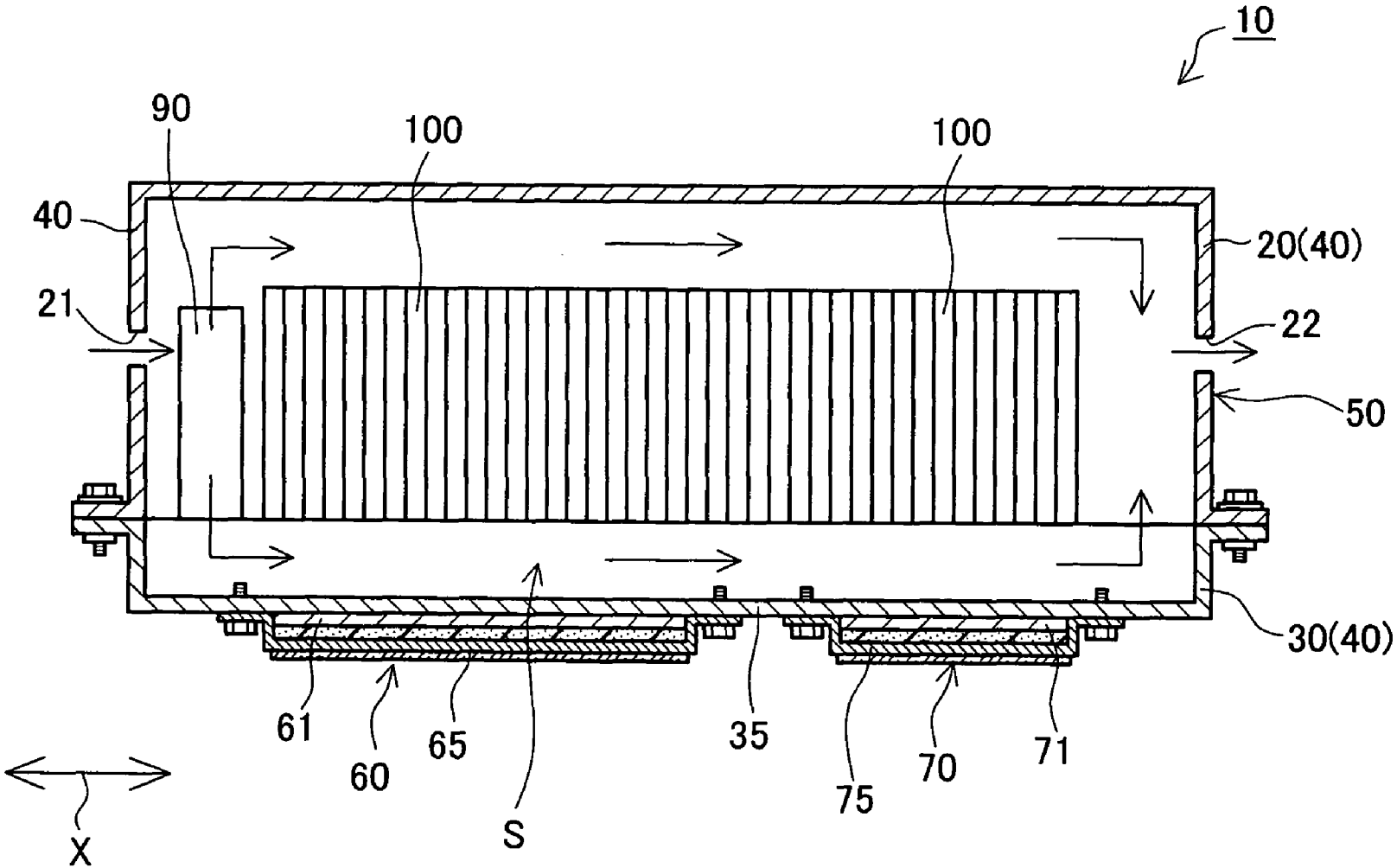
FIG. 11 is an explanatory view to show a cooling function of the battery structure with heater, taken along the line P-P of FIG. 1.

In the heater-equipped battery structure 10 of the present embodiment, as shown in FIG. 3, a cooling device 90 is placed in the housing case 40. If the temperatures of the secondary batteries 100 rise to high temperatures, the cooling device 90 is operated to cool the secondary batteries 100. More specifically, as shown in FIG. 11, upon activation, the cooling device 90 takes in outside air through a first air hole 21 of the first housing member 20, delivers cooled air (outside air) through the inside of the housing case 40 including the space S, and discharges the heat of the secondary batteries 100 out of the structure 10 through a second air hole 22. Thus, each of the secondary batteries 100 can be cooled appropriately. In the present embodiment, particularly, no heater exists between each secondary battery 100 and the air passage (including the space S) and therefore each secondary battery 100 can be cooled efficiently.

The present invention may be embodied in other specific forms without departing from the essential characteristics thereof.

In the above embodiment, for example, the battery structure to be heated is exemplified as the battery pack 50 having a plurality of secondary batteries 100 (forty batteries in the embodiment) and the housing case 40 that houses them. Alternatively, the battery structure may be configured as a cell constituted of a single power generating element accommodated in a battery case or a battery module including a plurality of power generating elements and a battery case having a plurality of compartments individually accommodating the power generating elements. In other words, the cell, the battery module, or others may be configured to be directly heated by a heater.

In the above embodiment, the secondary battery 100 is exemplified as a battery module including the battery case 101 integrally formed with six compartments 124 and the power generating elements individually accommodated in the compartments 124. Alternatively, the secondary battery may be a cell comprising a single power generating element accommodated in a battery case.

In the above embodiment, the secondary battery 100 provided with the resin battery case 101 and others is used. The material of the battery case is not limited to resin and may be selected from metal or other materials. Although the secondary battery in the above embodiment is a nickel-metal hydride storage battery, the present invention can also be applied to the case where the secondary battery is one of other batteries such as a lithium ion battery.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A heater unit for heating a battery structure, the battery structure including a housing case, a plurality of secondary batteries housed in the housing case, and a surface to be heated that is at least a portion of an outer surface of the housing case, the heater unit comprising:

a sheet heater of a laminated structure that defines a first surface and a second surface, the sheet heater including:

a heater element having an upper surface and a lower surface; and an insulating resin layer laminated on the upper surface and the lower surface of the heater element;

a holding member which holds the sheet heater, the holding member being arranged to be fixed to the outer surface of the housing case, the holding member having a flange with a contact surface; and a foam sheet placed between the second surface of the sheet heater and the holding member, the foam sheet being elastically deformable in at least a thickness direction of the sheet heater, wherein the foam sheet is deformable when the holding member is fixed to the outer surface of the housing case, the foam sheet pressing the entire second surface of the sheet heater such that the entire first surface of the sheet heater is in close contact with the surface of the battery structure to be heated, and the foam sheet being deformed such that the first surface of the sheet heater is aligned with the contact surface of the flange of the holding member.

2. The heater unit according to claim 1, wherein the foam sheet can be elastically compressed and deformed in the thickness direction of the sheet heater when the holding member is fixed to the battery structure, the battery structure bringing the first surface of the sheet heater in close contact with the surface of the battery structure to be heated by an elastic force caused by elastically compressive deformation of the foam sheet.

3. The heater unit according to claim 1, wherein the holding member is arranged to detachably attach the sheet heater to the battery structure.

4. The heater unit according to claim 1, wherein the foam sheet is placed on the entire second surface of the sheet heater.

5. The heater unit according to claim 1, wherein the sheet heater is bonded to the foam sheet, and the foam sheet is bonded to the holding member.

6. The heater unit according to claim 1, wherein the foam sheet has heat insulating properties.

7. A heater-equipped battery system, comprising:

a battery structure including:

a housing case;

a plurality of secondary batteries housed in the housing case; and a surface to be heated that is at least a portion of an outer surface of the housing case; and a heater unit including:

a sheet heater of a laminated structure that defines a first surface and a second surface, the sheet heater including a heater element having an upper surface and a lower surface and an insulating resin layer laminated on each of the upper surface and the lower surface;

a holding member which holds the sheet heater, the holding member being fixed to the outer surface of the housing case, the holding member having a flange with a contact surface; and a foam sheet placed between the second surface of the sheet heater and the holding member, the foam sheet being elastically deformable in at least a thickness direction of the sheet heater, wherein the foam sheet is deformed to press the entire second surface of the heater such that the entire first surface of the sheet heater is in close contact with the surface of the battery structure to be heated, and the foam sheet being deformed such that the first surface of the sheet heater is aligned with the contact surface of the flange of the holding member.

8. The heater-equipped battery system according to claim 7, wherein the first surface of the sheet heater is held in close contact with the surface of the battery structure to be heated by an elastic force caused by elastically compressive deformation of the foam sheet.

* * * * *